US008181375B2

(12) United States Patent
Tzuo

(10) Patent No.: US 8,181,375 B2
(45) Date of Patent: May 22, 2012

(54) FRONTAL PANEL DISPLAY WITH ASSEMBLY AND DISASSEMBLY AUTOMATIC SYSTEM

(76) Inventor: Chung Kwo Tzuo, Sao Paulo (BR)

( * ) Notice: Subject to any disclaimer, the term of this patent is extended or adjusted under 35 U.S.C. 154(b) by 241 days.

(21) Appl. No.: 12/297,176

(22) PCT Filed: Aug. 27, 2007

(86) PCT No.: PCT/BR2007/000216

§ 371 (c)(1),
(2), (4) Date: Mar. 26, 2009

(87) PCT Pub. No.: WO2008/064441

PCT Pub. Date: Jun. 5, 2008

(65) Prior Publication Data

US 2009/0255152 A1 Oct. 15, 2009

(30) Foreign Application Priority Data

Nov. 28, 2006 (BR) ..... 8602670 U

(51) Int. Cl.
*G09F 15/00* (2006.01)

(52) U.S. Cl. ..... 40/610; 40/539; 248/173; 248/459; 248/460

(58) Field of Classification Search ..... 40/539, 40/610; 248/473, 489, 173, 459, 460
See application file for complete search history.

(56) References Cited

U.S. PATENT DOCUMENTS

| | | | | |
|---|---|---|---|---|
| 2,601,374 | A * | 6/1952 | Ditzler et al. | 40/539 |
| 3,727,874 | A | 4/1973 | Wuensch | |
| 6,347,772 | B1 * | 2/2002 | L'Hotel | 248/174 |
| 6,508,023 | B2 * | 1/2003 | Moss et al. | 40/610 |
| 7,367,539 | B2 * | 5/2008 | Moss et al. | 248/460 |
| 7,437,842 | B2 * | 10/2008 | Sgambellone | 40/539 |
| 7,726,054 | B2 * | 6/2010 | Mestres Armengol et al. | 40/124.07 |
| 2005/0279906 | A1 | 12/2005 | Moss et al. | |

FOREIGN PATENT DOCUMENTS

| | | | |
|---|---|---|---|
| FR | 2 232 259 | A | 12/1974 |
| FR | 2 257 971 | A | 8/1975 |
| FR | 2 345 113 | A | 10/1977 |
| GB | 2430534 | A * | 3/2007 |

OTHER PUBLICATIONS

Search Report for WO2008/064441.

* cited by examiner

*Primary Examiner* — Casandra Davis

(74) *Attorney, Agent, or Firm* — Husch Blackwell LLP

(57) ABSTRACT

Frontal panel display with assembly and disassembly automatic system where a display receives, in the rear side (4) of its frontal panel, (1) two pairs (5) of cardboard to form the two hinges that, under the assembly unit (16) claw effect, allow the articulable boards (9) to lock perpendicularly to such panel (1) and, parallelly between them, form two supports to maintain the display straight while by the panel grooves (3) and boards grooves (12) and again under the assembly units (16) action, the display shall be folded and compacted. In another version, the frontal panel receives just one board, maintaining the same assembly and disassembly system as well as in other version, where the parallel boards pair is equally maintained locked in the perpendicular position in respect to the frontal panel so as to maintain the display assembled.

3 Claims, 8 Drawing Sheets

FRONTAL PANEL DISPLAY WITH ASSEMBLY AND DISASSEMBLY AUTOMATIC SYSTEM

Figure 1:
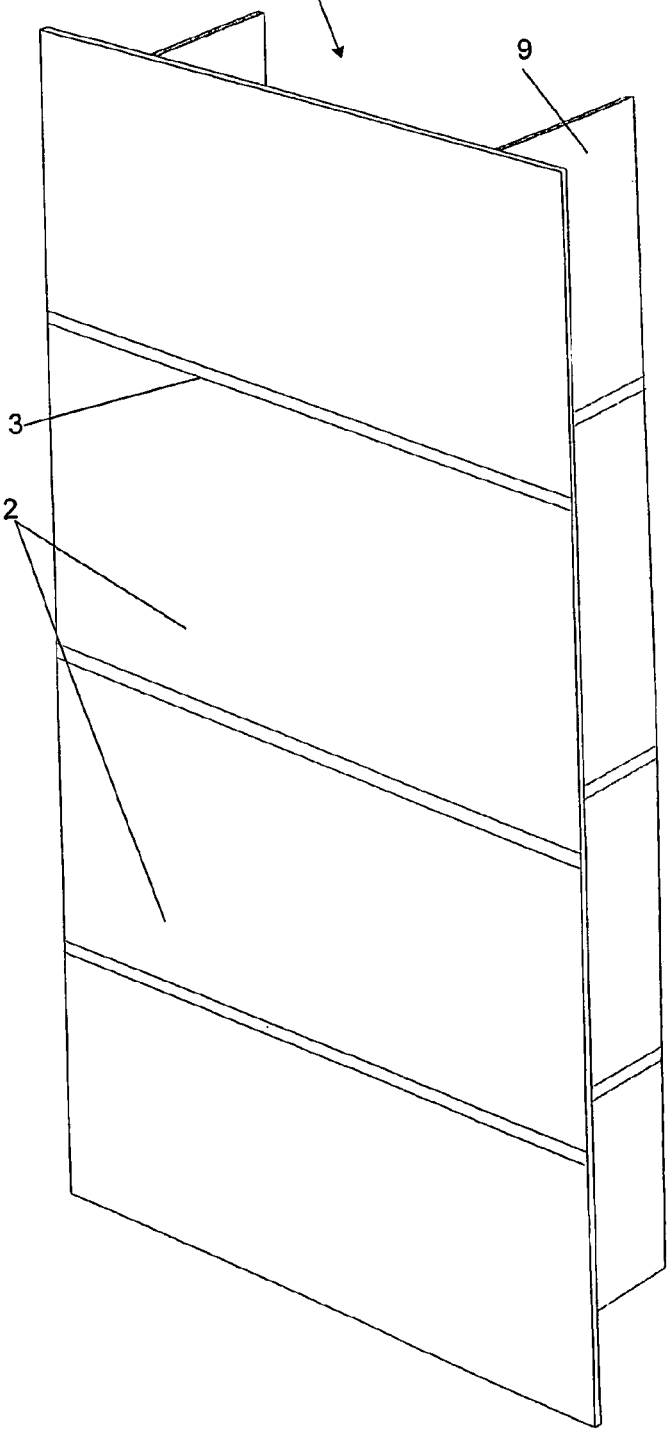

CROSS REFERENCE TO RELATED APPLICATIONS not applicable.

STATEMENT REGARDING FEDERALLY SPONSORED RESEARCH AND DEVELOPMENT not applicable.

THE NAMES OF PARTIES TO A JOINT RESEARCH AGREEMENT not applicable.

INCORPORATION BY REFERENCE OF MATERIAL SUBMITTED IN A COMPACT DISC not applicable.

BACKGROUND OF THE INVENTION

This descriptive report refers to the use model patent for a frontal panel display comprising gore formed from the groove which receives two paperboard in juxtaposition in its frontal side—each composed by one or more fixed boards and other folding and each pair is united by means of the wings and its indenture has the hook-shape, elastic band receivers tensioning the assembly units set and acting in the claw system. By positioning vertically the display, two back plate pairs undergo the assembly unit pressure (as the claw effect) and lock automatically the folding plates perpendicularly in respect to the frontal panel, and maintain the assembled display supported in soil. When removed from soil, the assembly units press the folding plates against it, opening them and allowing the display close automatically, by means of its groove and the grooves of the panel folding gore, which is compacted to transport, storage and stowage when it is not in use.

Optionally, there might only be two paperboards, which likewise perpendicularly lock each other in respect to the frontal panel and maintain the display assembled.

In other version there might be only one paperboard also perpendicularly lockable in respect to the frontal panel and allowing closing the display when it is opened in one side.

DESCRIPTION OF THE RELATED ART

An automatic assembly and disassembly display is known, which is proposed by the patent PI 0602006-2, the title "IMPROVING THE ASSEMBLY TOTEM-TYPE DISPLAY", deposited on May 18, 2006 where the display comprises two sides, united by wings in juxtaposition and turning inward forming basically an elliptic body, with folding gores by means of grooves.

The sides wings in juxtaposition have indentures in the hook-shape in each gore intermediate point, both in upper part and lower part, which received the elastic ends to tension the assembly unit and therefore, distributed all over the display.

Each assembly unit has a quadrangular section body whose walls are articulable by means of grooves and its two adjacent back walls are separated by a cut so as the piece has the claw effect under the elastic action, and the assembly unit is inserted to the juxtaposed wings by the cut and placed between the upper and lower hooks tensioned by the elastic. Thus placed, the tensioned assembly unit causes its walls, under the claw effect, to force the panel sides in juxtaposition outwards and maintain it assembled.

In order to have the display folded, the user just presses the sides against each other so as it wear down the elastic resistance, delineating the assembly units (again by its claw effect) to fold the display gore, making the transportation and stowage easier.

BRIEF SUMMARY OF THE INVENTION

The purpose of this utility model patent, proposed by the same inventor of PI 0602006-2, is forming a frontal panel display with folded gores by means of grooves, which receives in its back side the fixation of two cardboard pairs—each pair formed by a fixed board and other articulable board united by their wings in juxtaposition, having the indenture in the inverted hook-shape—upper and lower. The cardboard pairs are fixed, therefore, on the frontal panel rear side.

The assembly unit will be introduced by the hooks, acting in the claw system, with a quadrangular section body whose side and back walls are articulable by the grooves and such adjacent rear walls are separated by a cut.

Thus, the assembly units are inserted by its cut between the wings in juxtaposition of the cardboard pairs, and are maintained in tension by its elastics, anchored in the hooks.

Just slightly lifting the display, simultaneously to the gore unfolding, the articulable boards are automatically pressed by the effect of the assembly units claw and, as hinges, they are projected perpendicularly in respect to the frontal panel, thus forming a pair of supports in the back to maintain straight the display and exposing its frontal side with the advertisement.

The display being once more lifted, the assembly units pull the articulable boards, which also open as hinges, causing the gore automatic folding with its grooves, and thus closing the display.

The same system applies to articulate only one cardboard, by means of small variations, fixed on the frontal panel rear side. This likewise lock in perpendicular position to the frontal panel to maintain the display assembled, while to have the display closed, it is opened and the grooves coincide to the frontal panel gore, allowing folding and compacting the set.

In another version, the articulation occurs in just two cardboards, fixed on the frontal panel rear side, which lock themselves perpendicularly to the frontal panel and maintain it assembled.

CONCISE DESCRIPTION OF THE DRAWINGS

Figure 2:
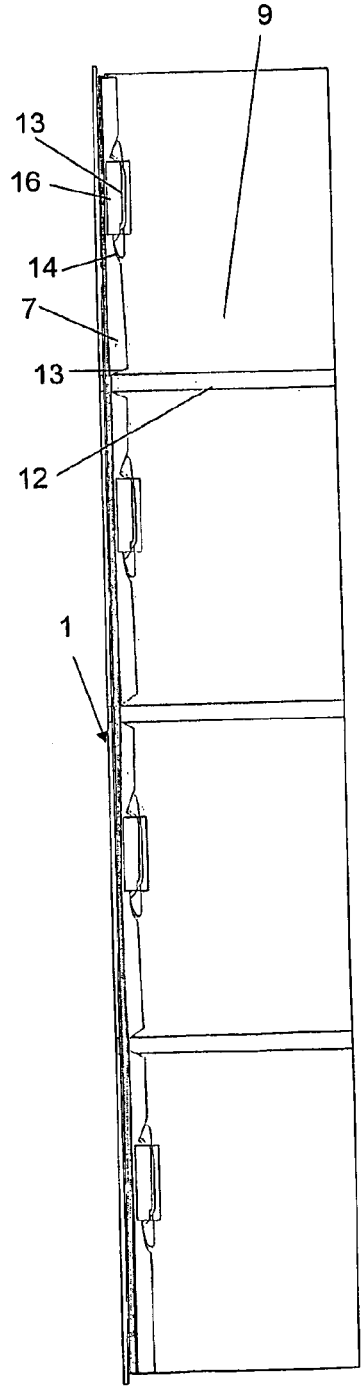
Figure 3:
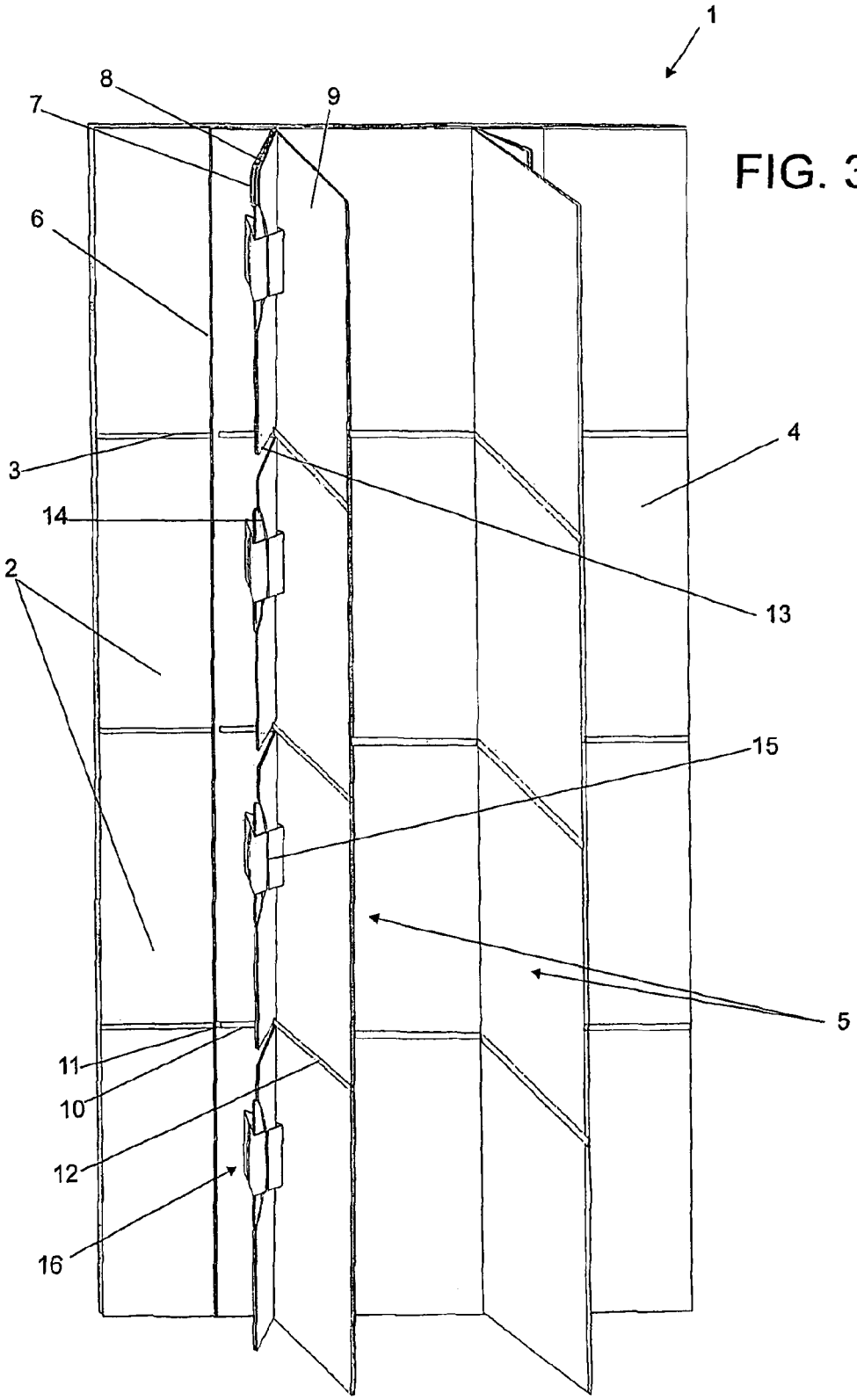
Figure 4:
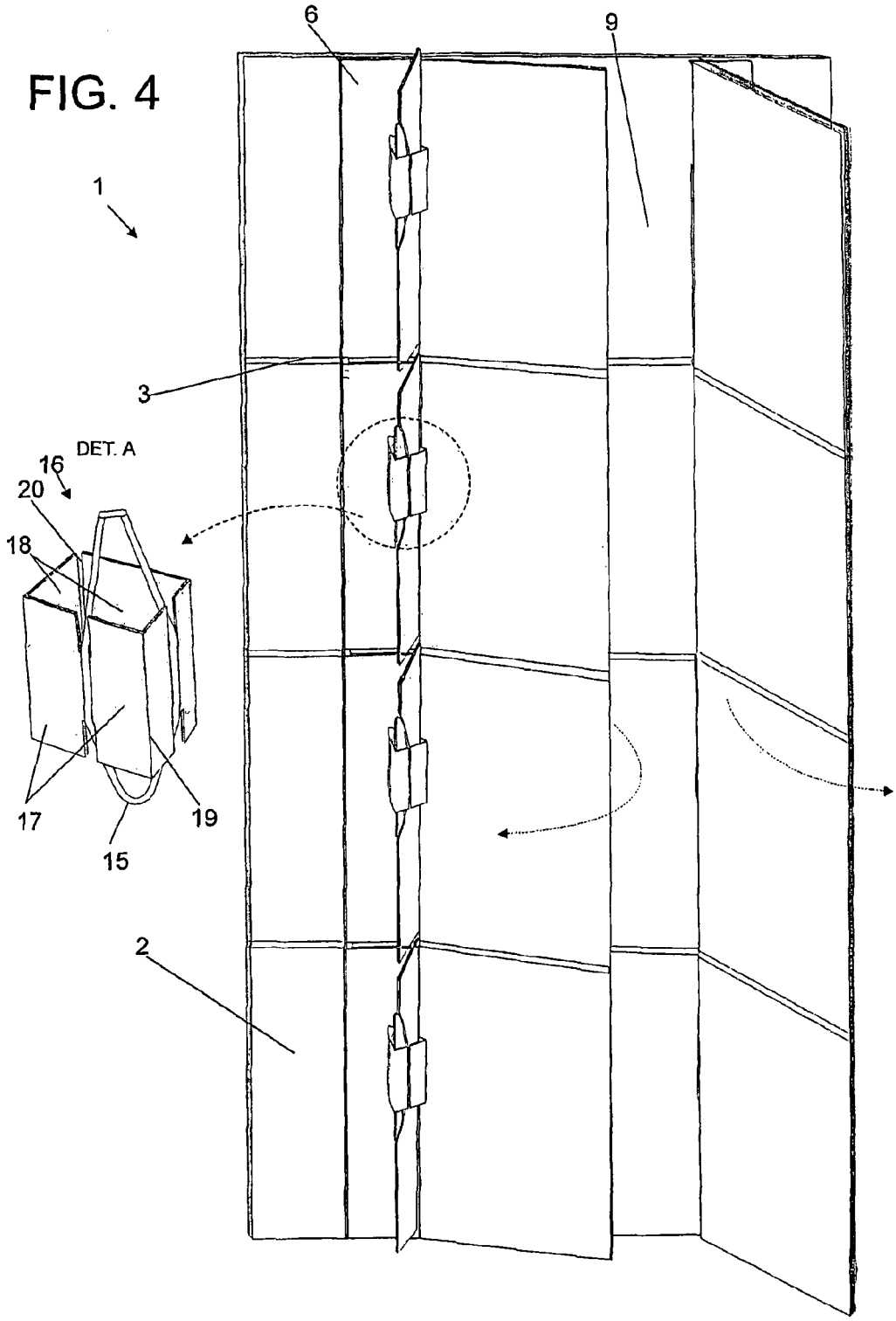
Figure 5:
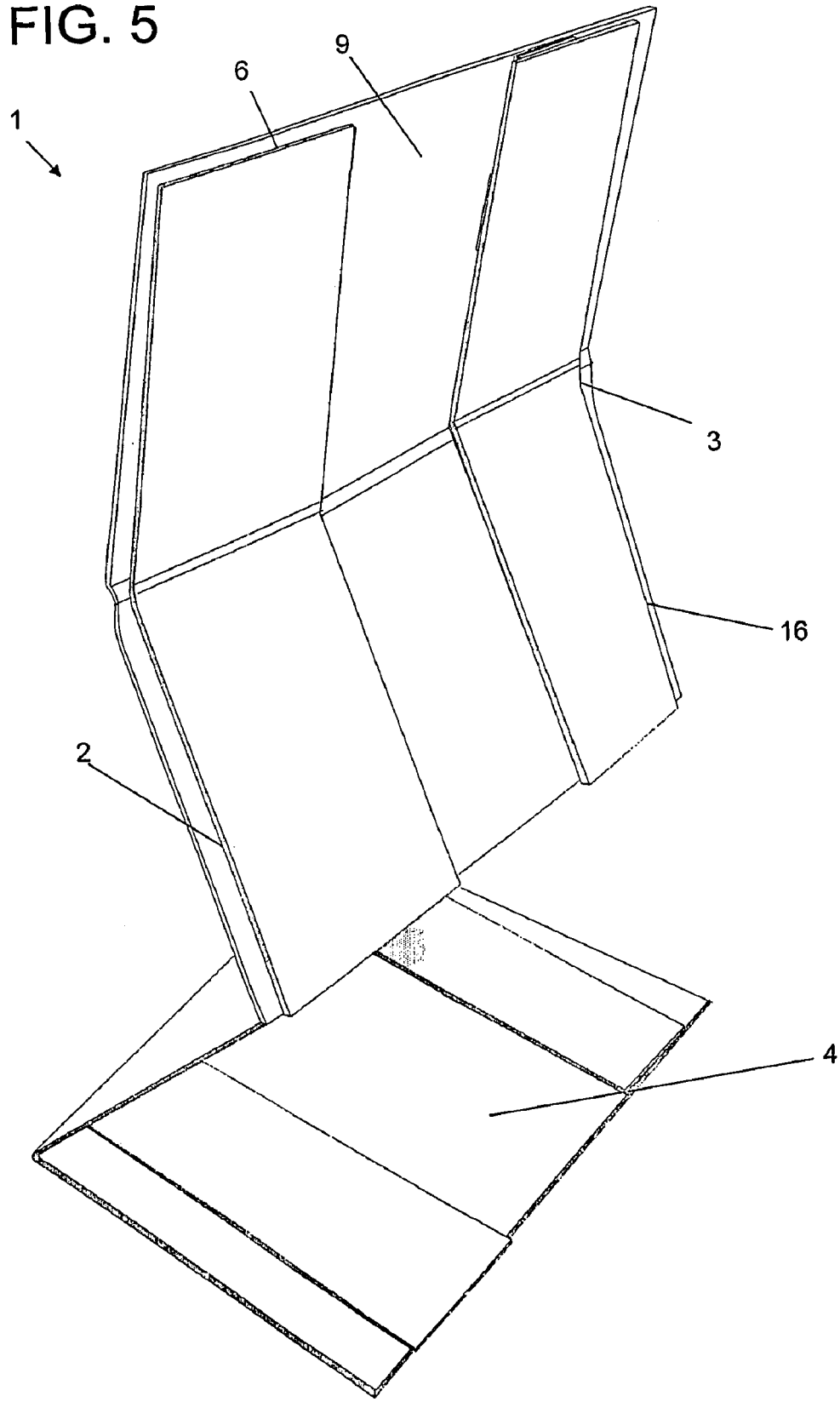
Figure 6:
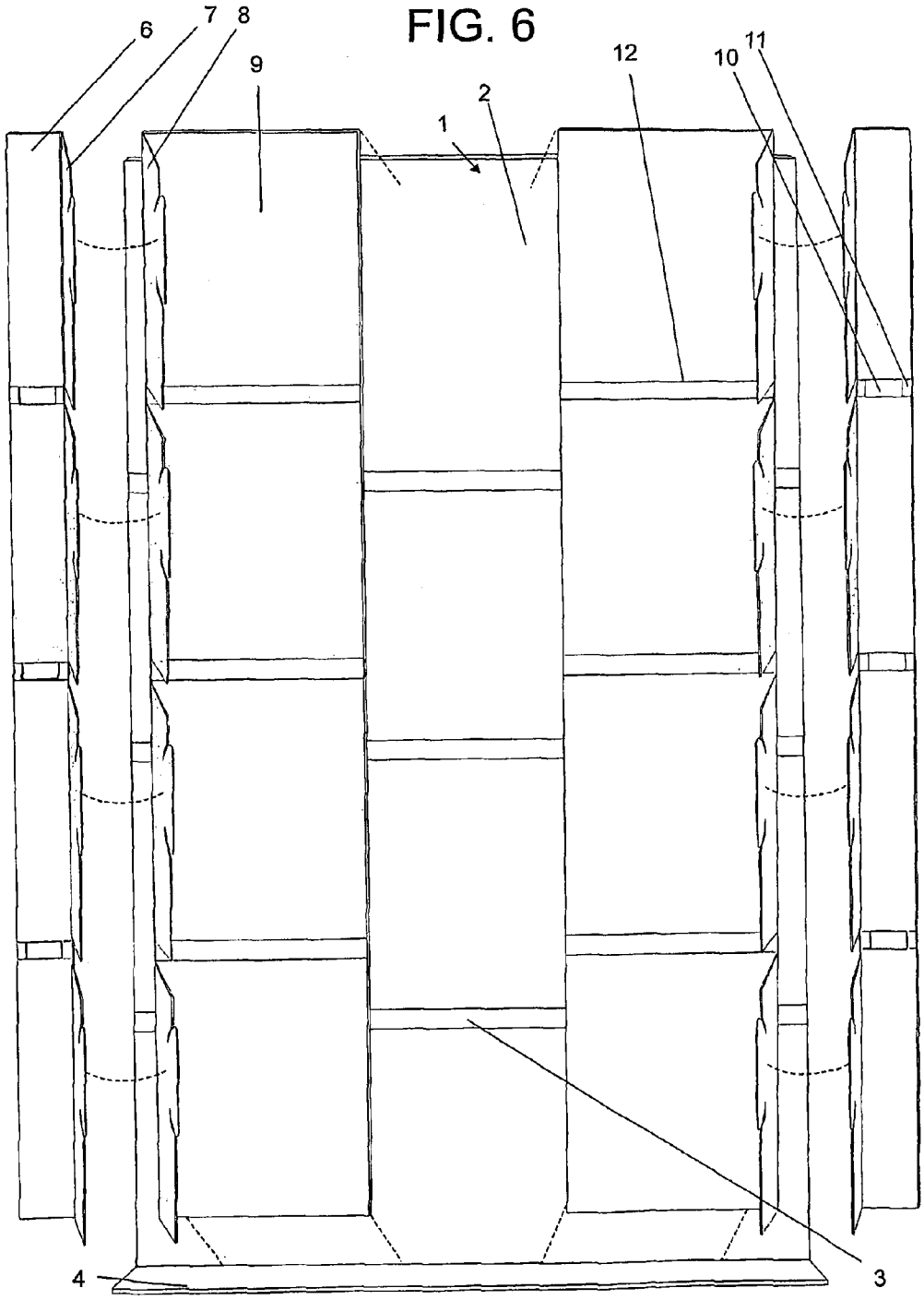
Figure 7:
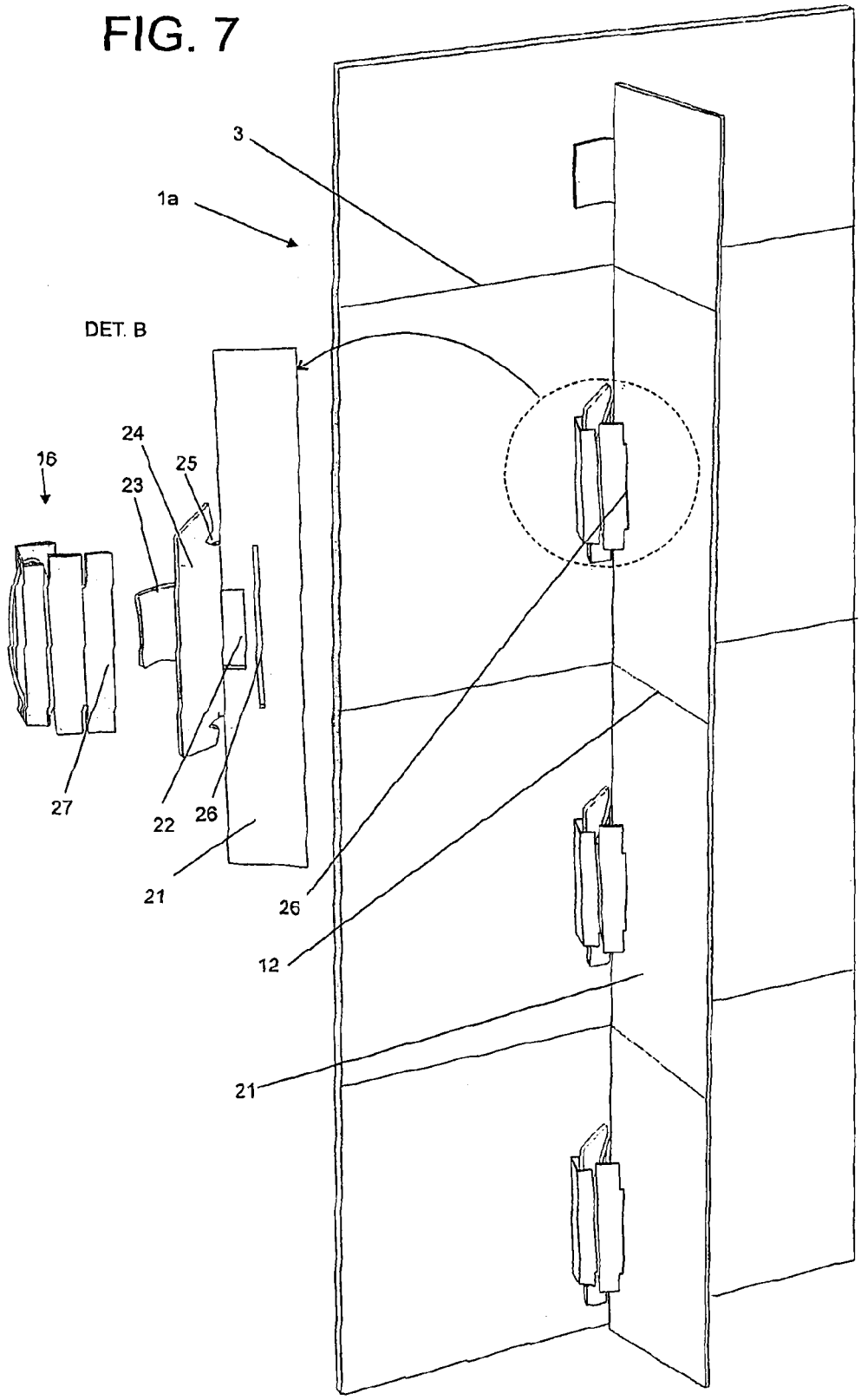
Figure 8:
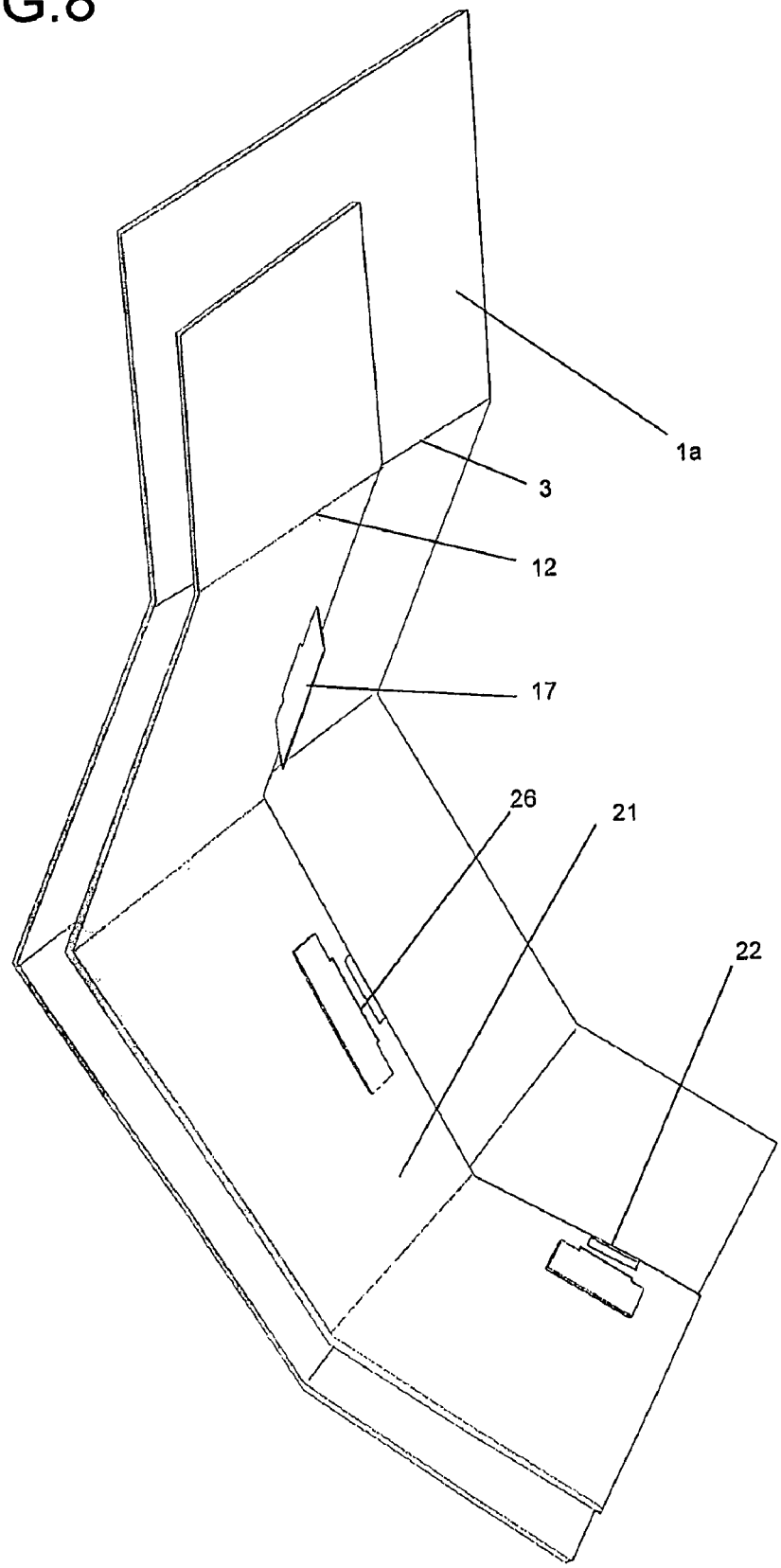
Figure 9:
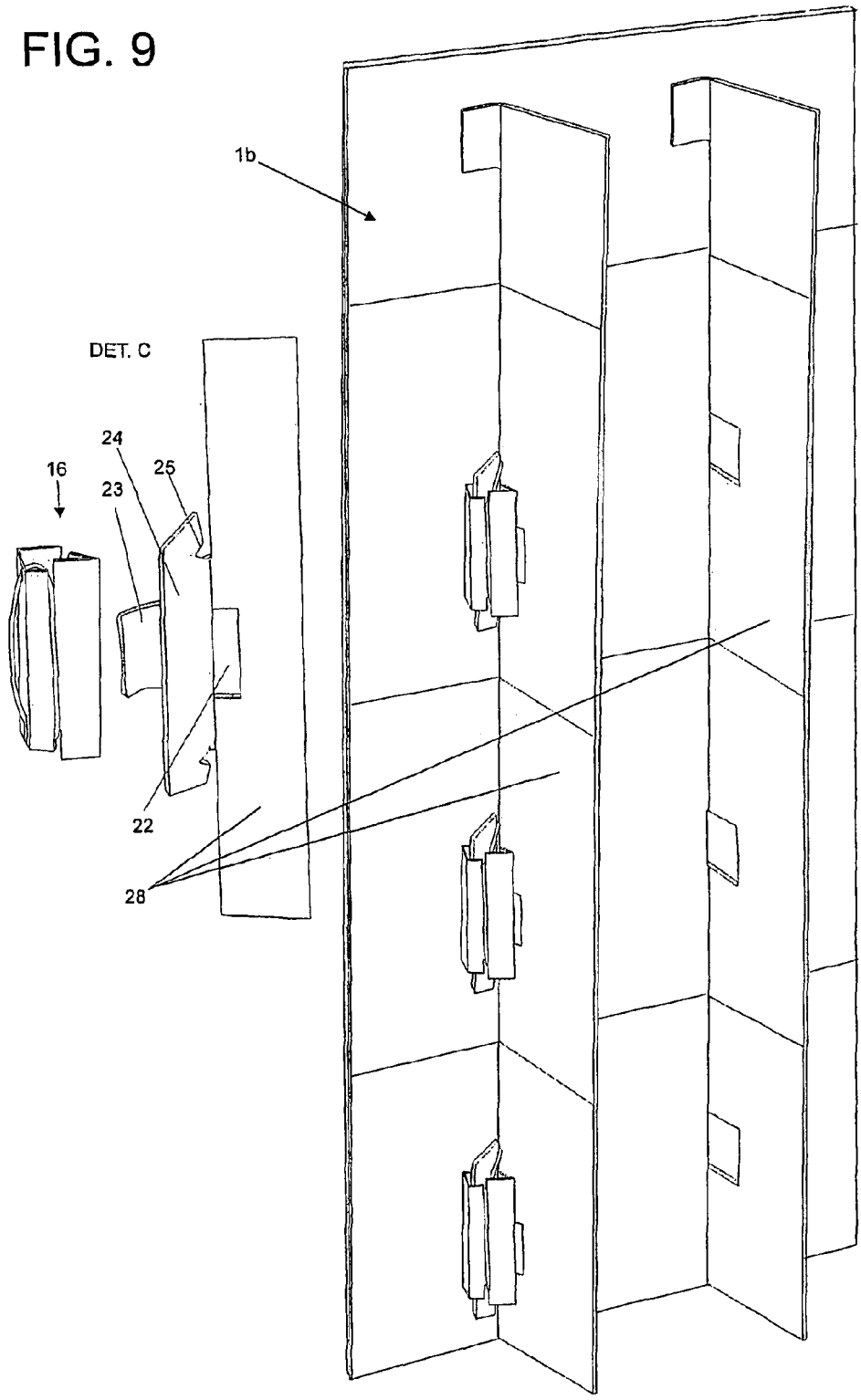

Being superficially explained, the frontal panel display is hereunder further detailed through the attached drawings, where:

FIG. 1—The frontal panel display perspective view in one version, with two cardboard pairs, in straight position with the two open articulable cardboards, tensioned by the assembly units;

FIG. 2—Side view, according to the former figure, showing the assembly units fixed, in the cardboard and maintaining the articulable boards open;

FIG. 3—Display rear view according to the former figure;

FIG. 4—View according to the former figure, showing one articulable board already open and the other opening to the folding together with the display gore;

FIG. 5—View according to the former figure, showing the display being folded by its grooves, after the articulable boards are opened by the assembly unit's action, acting in the claw effect;

FIG. 6—View in the rear perspective, showing two cardboard pairs—a fixed board and an articulable board united by their wings. As noted, two pairs are fixed so as their articulable boards remain in juxtaposition;

FIG. 7—View in display perspective in the version with just one cardboard, fixed on the frontal panel rear side. The board is fixed by the wings to the frontal panel by receiving the assembly units (fixed by the tongue), in order to be locked and maintaining the assembled display;

FIG. 8—View in perspective according to the former figure, showing the display being folded and the opening to one side of the rear board;

FIG. 9—Viewing the display in perspective in the two-cardboard version also fixed by wings and locked in the perpendicular position to the frontal panel by the assembly units.

DETAILED DESCRIPTION OF THE INVENTION

According to the attached drawings, the "FRONTAL PANEL DISPLAY WITH THE ASSEMBLY AND DISASSEMBLY AUTOMATIC SYSTEM", is constituted by one frontal panel display formed by the cardboard piece (1) with gores (2) obtained by grooves (3).

The piece (1) receives in its rear side (4), on all its sides height, two cardboard pairs (5) and each pair is composed by a fixed board (6) with a wing (7), which is juxtaposed to the wing (8) coinciding with a second articulable board (9), as mainly illustrated by FIG. 6.

The fixed boards (6) have indenture (10) and grooves (11) and the articulable boards (9) have grooves (12) limiting the folds, which coincide with the piece (1) gores (2) grooves (3).

On wings (7) and (8) of connection of the pairs (5) of the fixed (6) and articulable (9) boards, beveled cuts (13) next to the grooves (11) and (12) are performed, while in the intermediate points the wings (7) and (8) of the connection receive the indenture in the inverted hooks-shape (14), both upper and lower.

In each indenture (14) between two ends, an elastic band (15) is fixed that tensions the assembly unit (16), each one formed by a body in the quadrangular section with two frontal walls (17), adjacent to the two rear walls (18) articulated by common grooves (19), and such rear walls (18) are separated by a cut (20), by which the assembly unit (16) is introduced between the juxtaposed wings (7) and (8) of the fixed (6) and articulable (9) boards, as illustrated mainly in the detail "A" of the FIG. 4.

The elastic band (15) thus tensioning it and placed between the upper and lower ends of the hooks (14), each assembly unit (16) lean its rear walls (18) between the fixed board (6) and the articulable board (9).

Each tensioned assembly unit (16), thanks to the claw effect obtained by the grooves (19) and the cut (20) separation between the rear walls (18), maintain the two articulable boards (9) pressed.

For the vertical positioning, the articulable boards (9) are automatically pressed by the effect of the assembly units (16) claw as hinges, being perpendicularly projected in respect to the frontal panel, thus forming a pair of back supports on the wing (4), as shown in the FIGS. 1, 2 and 3, to maintain straight the display and exposing its frontal side with the advertisement.

The display being once more lifted, the assembly units (16) pull the articulable boards, (9) which also open as hinges, aligning its grooves to the gore (2) grooves (3), causing its automatic folding and thus closing the display, as illustrated by the FIG. 5.

For another version of the display, only the cardboard (21) with grooves (12) has indentures (22) that originate the foldable bands (23) by which it is fixed to the rear side (4) of the frontal panel (Ia). Aligned to the indentures (22), the board (21) projects, from its back edge, the wings (24) with bevel (25) in its ends and has, in the opposite side, a split (26).

The board (21) is fixed to the display rear side (4) by the strips (23) and receives the elastic bands (15) by the bevel (25) in its wings (24) to fix the assembly units (16). In such version, the assembly units (16) have an additional tongue (27) introduced in the split (26) so as according to the system, press perpendicularly the board (21) in respect to the frontal panel (Ia), locking it and maintaining the display assembled.

The board (21) being slightly turned to the side, the assembly units (16) are delineated by its claw system, and grooves (12) of the board (21) coincide with the gore (2) grooves (3), being possible to close the display, as illustrated by FIG. 8.

Finally, in other variation, the display might receive two boards (28) equally having the indentures (22) that originate the foldable strips (23) and also wings (24) with bevel (25). Likewise in the version, the boards (28) are fixed to the rear side (4) of the frontal panel (Ib) by their strips (23) and they receive the assembly units (16) by the wings (24) with bevels (25). Those, according to the system, lock the opened boards (28), perpendicularly to the frontal panel, (Ib), maintaining the display assembled.

The invention claimed is:

1. A front panel display with automatic assembly and disassembly display system which in a collapsed situation is in a folded and compact condition and in an upright situation has a front panel display with a first panel with grooves and comprising two support panels, each support panel having a second panel with a first wing which is adjacent to and a mirror image of a second wing on a third articulable panel, each of the first and second wings having at least two indentations, and the third panel having third panel grooves, the third panel grooves coinciding with the first panel grooves and the first and second wings are adjacent one another and are secured with an elastic band fixed in the at least two indentations to secure the second and third panel to form an assembly unit comprising a quadrangular section body with two front walls adjacent to two rear walls, so that the assembly unit tensioned by the elastic band biases the rear walls between the second panel and third panel and remains in an assembled state.

2. The front panel display with automatic assembly and disassembly system of claim 1 wherein the second panel is locked by being maintained by the bias of said elastic band and forming a rear support to maintain the display assembled and standing.

3. The front panel display with automatic assembly and disassembly system according to claim 1 wherein the upstanding panel is fixed to a rear side of the front panel and receives elastic bands in the indentations of the wings thereby holding the assembly units together with a tongue in the slot.

* * * * *